US006595512B2

(12) United States Patent
de Koning et al.

(10) Patent No.: US 6,595,512 B2
(45) Date of Patent: Jul. 22, 2003

(54) CONSTANT FORCE SHEET FEEDER

(75) Inventors: Petrus T. de Koning, Toronto (CA); Raymond Ruthenberg, Etobicoke (CA)

(73) Assignee: Xerox Corporation, Stamford, CT (US)

( * ) Notice: Subject to any disclaimer, the term of this patent is extended or adjusted under 35 U.S.C. 154(b) by 223 days.

(21) Appl. No.: 09/731,374

(22) Filed: Dec. 6, 2000

(65) Prior Publication Data

US 2002/0135120 A1 Sep. 26, 2002

(51) Int. Cl.[7] ..... B65H 3/52
(52) U.S. Cl. ..... 271/125
(58) Field of Search ..... 271/124, 125, 271/274

(56) References Cited

U.S. PATENT DOCUMENTS

| | | | | | |
|---|---|---|---|---|---|
| 4,346,880 | A | | 8/1982 | Roller et al. | 271/186 |
| 4,605,218 | A | * | 8/1986 | Knepper et al. | 271/274 X |
| 4,627,607 | A | * | 12/1986 | Ishii | 271/274 X |
| 4,801,134 | A | * | 1/1989 | Yokoyama et al. | 271/125 X |
| 5,004,218 | A | | 4/1991 | Sardano et al. | 271/35 |
| 5,011,124 | A | | 4/1991 | Sardano et al. | 271/35 |
| 5,016,866 | A | * | 5/1991 | Takahashi | 271/125 X |
| 5,346,199 | A | | 9/1994 | Martin et al. | 271/110 |
| 5,435,540 | A | | 7/1995 | Martin et al. | 271/122 |
| 5,884,910 | A | * | 3/1999 | Mandel | 271/274 X |
| 5,913,268 | A | | 6/1999 | Jackson et al. | 101/420 |
| 5,978,622 | A | | 11/1999 | Wenthe, Jr. | 399/98 |
| 5,988,622 | A | | 11/1999 | Shigeta | 271/9.01 |
| 5,988,635 | A | * | 11/1999 | Ohshima | 271/274 |
| 5,996,990 | A | * | 12/1999 | Kawashima | 271/125 X |
| 6,027,111 | A | | 2/2000 | Rubscha et al. | 271/123 |
| 6,059,279 | A | | 5/2000 | Wenthe, Jr. | 271/10.13 |
| 6,318,717 | B1 | * | 11/2001 | Daboub et al. | 271/124 |

* cited by examiner

*Primary Examiner*—David H. Bollinger
(74) *Attorney, Agent, or Firm*—Perman & Green, LLP

(57) ABSTRACT

A document creating apparatus, comprising an image transfer system and a feeder. The feeder has a frame, housing and a roll for individually feeding sheets of material within the image transfer system. The housing is pivotally connected to the frame on a pivot axis. The roll is pivotally connected to the housing on a roll axis that is offset from the pivot axis. A spring is connected to the housing and the frame at an offset distance from the pivot axis. When the offset distance decreases, the force exerted by the spring increases. When the offset distance increases, the force exerted by the spring decreases. The force exerted by the spring between the first roll and the second roll as a result is maintained substantially constant.

22 Claims, 7 Drawing Sheets

CONSTANT FORCE SHEET FEEDER

BACKGROUND OF THE INVENTION

1. Field of the Invention

The present invention relates to a sheet feeding system and, more particularly, to a sheet feeding system having a substantially constant nip force.

2. Prior Art

Many different sheet feeding devices are known in the sheet feeding art. For example, U.S. Pat. No. 5,435,540 discloses a sheet feeding and separating apparatus for feeding sheets from a stack by exerting a drive force against the top sheet where the sheet is urged off the stack by a nudger roll toward a retard nip formed where a feed roll contacts a retard roll. Another example, U.S. Pat. No. 5,988,622 discloses a paper feeding device that includes a plurality of horizontally juxtaposed paper cassettes for containing papers. Another example, U.S. Pat. No. 5,978,622 discloses a moving document imaging system in which documents are sequentially fed from a stack. All three of the above referenced patents are incorporated by reference herein in their entirety. Some general examples of sheet separator-feeders include: retard-type spring reverse driven retard roller sheet separator-feeders; similar separator-feeders with driven reverse rotation of retard rollers, instead of springs; fixed retard pad systems; and semi-active retard separator-feeders. In each of these systems, the drag of a retard roll or pad is set to provide resistance, so that if two or more sheets are in the retard nip, normally only the one sheet engaged by the feed roll will be driven downstream out of the retard nip, and the others will be retarded there. One of the most difficult problems in feeding sheets, including original documents sheets being fed to be imaged and the image stored and/or printed, as here, is separating and feeding the sheets sequentially, only one at a time, at the desired time, from a stack of sheets. That is, to avoid "double feeds", sheet overlaps, nonfeeds, or other misfeeds. Sheets can vary widely in size and weight, stiffness, age, humidity, curl, size and other properties complicating the separation and feeding at the proper time of only one sheet at a time. Feed and retard rolls serve the purpose of separating sheets from a stack and feeding them into the copier, printer or other document handling device as the case may be. One of the difficult parameters to control in a feed/retard drive system is the normal force exerted between the feed roll and the retard roll. If the normal force is high, the rolls will feed more than one sheet creating an error. If the normal force is too low, the rolls will feed no sheet creating an error. For systems that utilize a spring loaded approach to establishing the normal force exerted between the feed roll and the retard roll, factors such as roll manufactured diameter tolerances, roll wear diameter over time, sheet thickness being fed, spring constant tolerances, spring preload tolerance and mounting component tolerances affect the value of the critical normal force. Accordingly, there is a desire to provide a spring loaded sheet feeding device where the normal force exerted between the feed roll and the retard roll is affected as little as possible by these tolerances and component wear over time.

In the description herein the term "document" or "sheet" refers to various flimsy physical sheets of paper, plastic, or other suitable physical image substrates.

SUMMARY OF THE INVENTION

In accordance with one embodiment of the present invention, a sheet feeder system is provided for use in a document creating apparatus. The feeder has a frame, housing and a roll for individually feeding sheets of material within an image transfer system of the document creating apparatus. The housing is pivotally connected to the frame on a pivot axis. The roll is pivotally connected to the housing on a roll axis that is offset from the pivot axis. A spring is connected to the housing and the frame at an offset distance from the pivot axis. When the offset distance decreases, the force exerted by the spring increases. When the offset distance increases, the force exerted by the spring decreases.

In accordance with another embodiment of the present invention, a sheet feeding apparatus is provided for use in a document creating apparatus. The sheet feeding apparatus has a frame, a linkage and a first and second roll for individually feeding sheets of material. The linkage and the second roll are connected to the frame. The first roll is connected to the linkage. A spring is connected to the frame and the linkage and provided to exert a force between the first roll and the second roll. When the distance between the axis of rotation of the first roll and the second roll is varied, the force exerted by the spring between the first roll and the second roll is maintained substantially constant.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
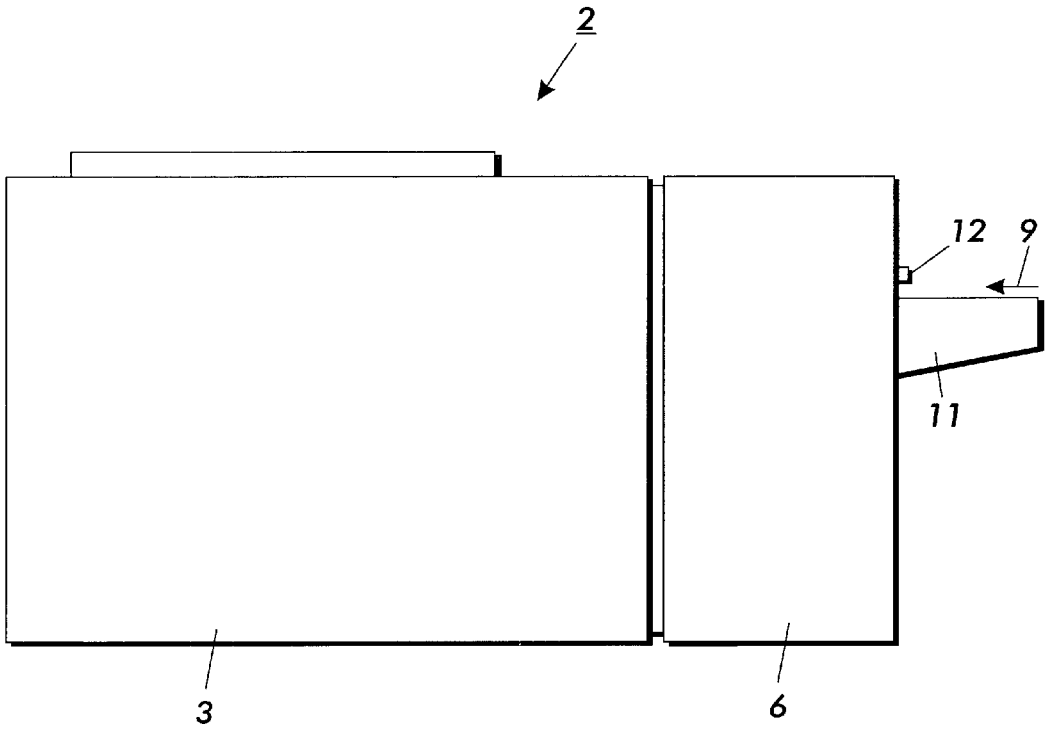
FIG. 1 is a schematic view of a document creating apparatus.

Referring to FIG. 1, there is shown, in schematic form, a view of a document creating apparatus 2 for creating documents in accordance with teachings of the present invention. Although the present invention will be described with reference to the single embodiment shown in the drawings, it should be understood that the present invention can be embodied in many alternate forms of embodiments. In addition, any suitable size, shape or type of elements or materials could be used. A copying or printing system of the type shown is preferably adapted to provide duplex or simplex stacked document sets from duplex or simplex collated document or print sets which result from either duplex or simplex original documents or output document computer files for print. Document creating apparatus 2, in the embodiment shown, is a copier. However, in an alternate embodiment, the apparatus could be a printer or any other suitable type of document creating apparatus. Document creating apparatus 2 generally comprises a xerographic processing or printing section 3, a finishing section 6 and an output section 9. Printing section 3 can be an electrostatographic printing system such as made by Xerox Corporation or alternately other xerographic or other type of printing apparatus. Printing section 3 incorporates an image transfer system and a transport system for transporting sheets of material. Finishing section 6 may typically incorporate a hole punch, a stapler, or any other suitable type of feature known in the art. Output section 9 incorporates a tray 11 or a bin sorter that accepts and stacks documents or document sets output from finishing section 6 at output zone 12. Documents are printed or copied in printing section 3 and output from printing section 3 to finishing section 6. Documents can be sorted and bound at finishing section 6. Document sets can be output from finishing section 6 at output zone 12.

Figure 2:
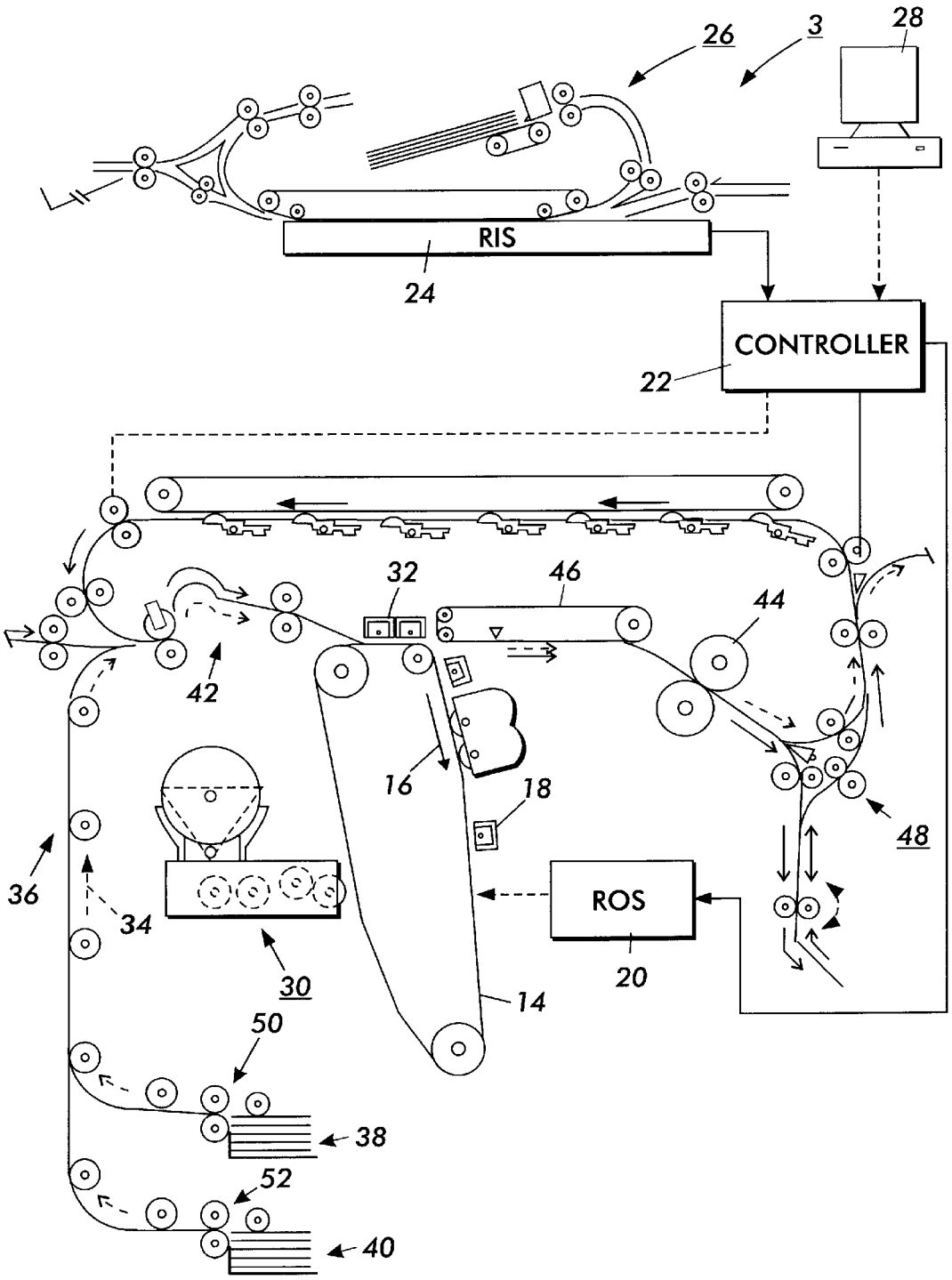
FIG. 2 is a schematic elevation view of a xerographic processing or printing section.

Referring now also to FIG. 2, there is shown is a schematic elevation view of one embodiment of the xerographic processing or printing section 3. The printing section 3 has a photoconductive belt 14 that advances in the direction of arrow 16. Photoconductive belt 14 passes through charging station 18 and exposure station 20 which is typically a raster output scanner that transmits a latent image from controller 22 onto the photoconductive surface of photoconductive belt 14. Controller 22 gets the image from input scanner 24 that typically incorporates a CCD and scans an image from document handler 26. Alternately, controller 22 gets the image from a separate computer 28 when printing section 3 operates as a printing device. Photoconductive belt 14 then advances to development station 30 where toner is electrostatically attracted to the latent image. Photoconductive belt 14 then advances to image transfer station 32. A sheet of material 34 is advanced from sheet stack 38 or sheet stack 40 by a sheet transport system 36 that includes registration system 42 and retard type sheet separator-feeder system 50 and 52 according to the present invention. Sheet 34 is advanced to registration system 42 that registers sheet 34 and then advances sheet 34 past image transfer station 32 in a timed fashion. The toner deposited on the latent image of photoconductive belt 14 is transferred to sheet 34 due to sheet 34 becoming charged at image transfer station 32 and due to sheet 34 being registered or timed relative to the latent image. Sheet 34 is then advanced to fusing station 44 by belt 46 where the toner image is permanently affixed to sheet 34, typically by heating, thus creating a document sheet. Sheet 34 will either be output to a finisher or a stacker or inverted at inverter 48 and recirculated through the printing section to have a second image deposited on its opposite side. Although the section 3 of the apparatus 2 has been described in detail above, features of the present invention could be used with other types of xerographic processing or printing sections having any suitably blank paper or sheet supply, created document output, image transfer system or paper path. The description above is merely intended to be exemplary. More or less features could also be provided. Although retard type sheet separator-feeder system 50 and 52 are shown at a fixed positions within the copying or printing apparatus, these positions are intended to be exemplary and various alternative locations and modifications can be devised by those skilled in the art without departing from the invention. Such an alternative, for example, would be incorporating retard type sheet separator-feeder system 50 or 52 at any point in the paper path of a copying or printing apparatus where the paper path is either upstream or downstream of the printing or copying operation. An additional alternative, for example, would be incorporating belts instead of rollers within separator-feeder system 50 or 52.

Figure 3:
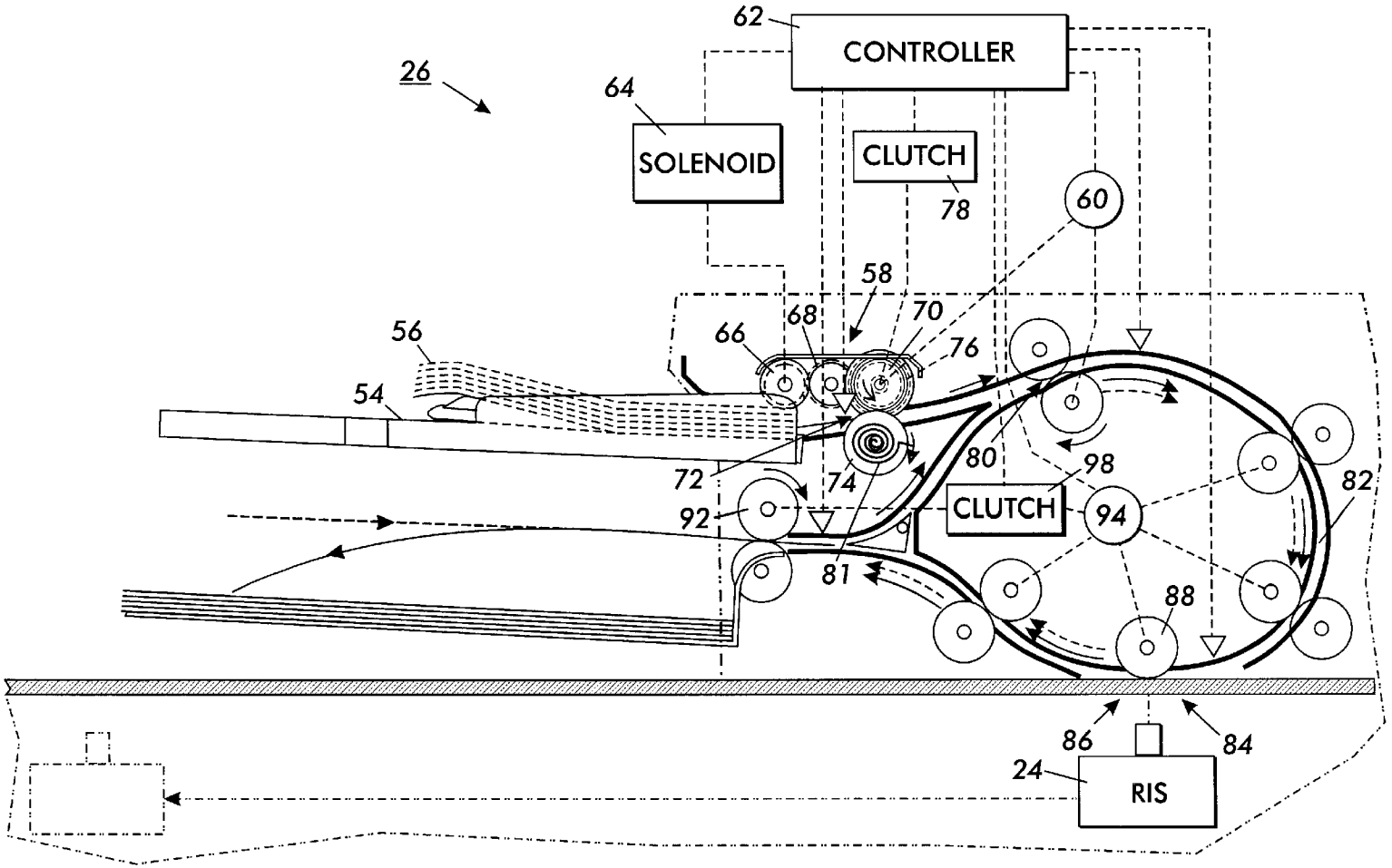
FIG. 3 is a schematic elevation view of a document handler that incorporates an input scanner.

Referring now to FIG. 3 there is shown is a schematic elevation view of one embodiment of the document handler 26 that incorporates input scanner 24. The document handler 26 has a document sheet stacking input tray 54 in which the document sheets to be imaged are stacked. The top sheets 56 from the sheets stacked in that tray 54 are sequentially fed from the tray 54 with a semi-active retard type sheet separator-feeder system 58 driven by a motor 60 and conventionally controlled by a controller 62. Controller 62 may be independent as shown or incorporated into controller 22 referred to in FIG. 3. In the separator-feeder system 58, a sheet 56 is separated from its underlying sheets, first by intermittent engagement (actuated by a solenoid 64) of the top sheet by a nudger roll 66 (driven by gear 68 driven off the drive of the feed roller 70). Overlapping sheets are then separated in a feeder—retard nip 72. The feeder—retard nip 72 here is defined by an underlying retard (drag) roller 74 engaged by an intermittently driven feed roller 70. The sheet 56 is then fed downstream by the feed roller 70 driven by a drive system 76 connection to motor 60, via the clutch 78 schematically indicated, to a driven takeaway roller nip 80 (which may also have a sheet acquisition sensor). The retard roller 74 may be torque biased for retarding sheets by an internal drag wrap spring 81. The document sheet 56 that has been separated and fed out is fed downstream in a document feeding and inverting loop path 82 to the imaging station 84 which is a small area of the upper surface of the stationary platen glass 86, against which the moving document 56 is held down by a roller 88, while the document is being sequentially imaged through the platen glass 86 by the imager, here the "RIS" (raster input scanner) 24. After scanning, the document may be ejected by exit rolls 92 into the illustrated output tray or, if it is a duplex document, inverted and refed back through path 82 with the clutch 98 shown connecting to reverse the exit rolls 92 for imaging its second side, as explained in detail in the above-cited patents on that feature. Although the document handler 26 of the xerographic processing or printing section 3 has been described in detail above, features of the present invention could be used with other types of xerographic processing or printing sections having any suitably blank paper or sheet supply, created document output, image transfer system or paper path. The description above is merely intended to be exemplary. More or less features could also be provided. Although retard type sheet separator-feeder system 58 is shown at a fixed position, this position is intended to be exemplary and various alternative locations and modifications can be devised by those skilled in the art without departing from the invention. Such an alternative, for example, could be incorporating retard type sheet separator-feeder system 58 into the retard type sheet separator-feeder system 50 or 52 are shown in FIG. 2. An additional alternative, for example, would be incorporating belts instead of rollers within separator-feeder system 58.

Figure 4:
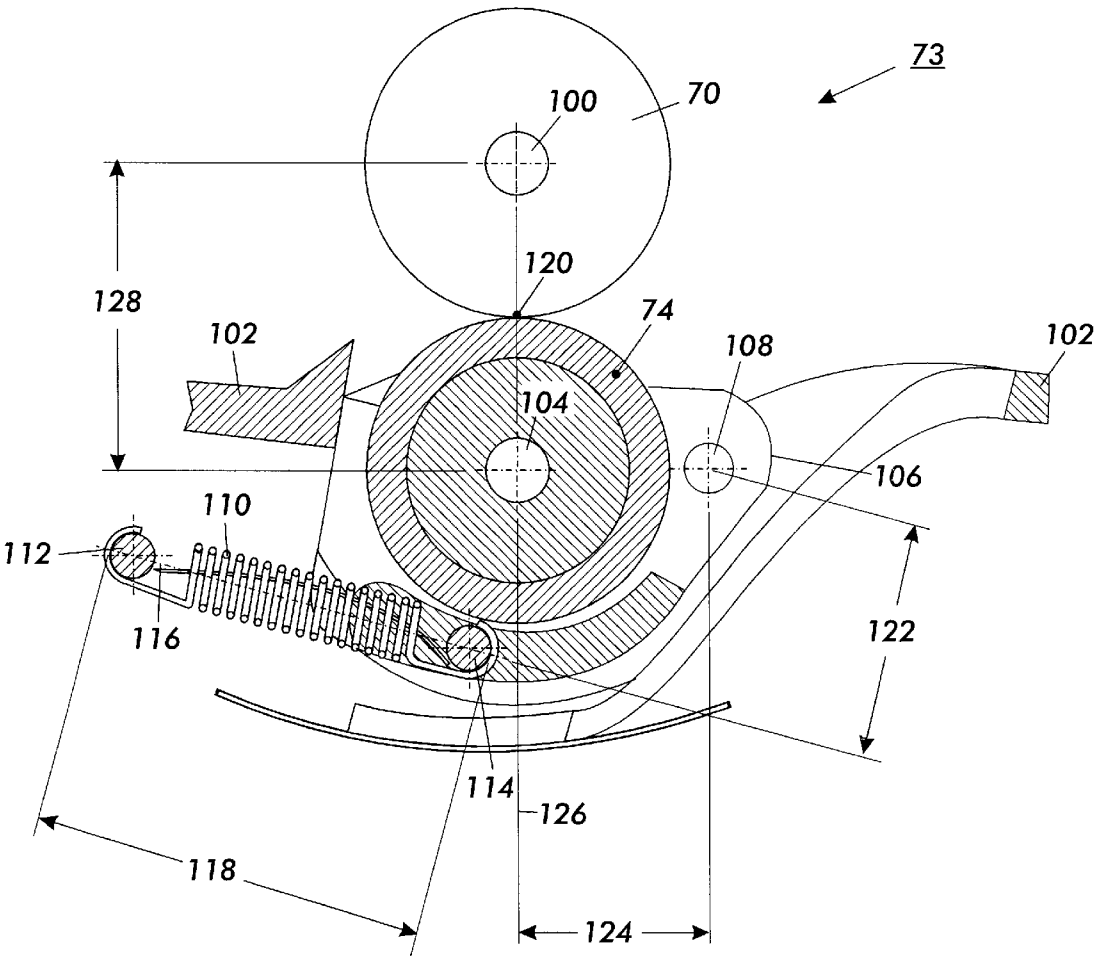
FIG. 4 (PRIOR ART)
FIG. 4 is a schematic elevation view of a prior art drive.

Referring now to FIG. 4 there is shown is a schematic cross sectional elevation view of a prior art embodiment of a feeder—retard nip 73. The feeder—retard nip 73 here is defined by an underlying retard (drag) roller 74 engaged by an intermittently driven feed roller 70. Feed roller 70 is rotatable about a feed roll axis 100 which is mounted to frame 102. Retard roller 74 is rotatable about a retard roll axis 104 which is mounted to housing 106. Housing 106 is pivotable about pivot axis 108 which is mounted to frame 102. A spring 110 is connected to frame 102 at frame pin 112 and to housing 106 at housing pin 114. Spring 110 exerts a spring force between frame 102 and housing 106 along a spring axis 116. The magnitude of this spring force is typically equal to (length 118—spring 10's length at rest)× spring 110's spring constant in force per unit length+spring 110's initial preload. For an extension spring as shown, this spring force would increase as length 118 increases and decrease as length 118 decreases. The spring force creates a nip force along a nip force axis 126 at point 120 which is the contact point between roller 74 and roller 70. The nip force is easily computed by summing moments about to the center of rotation of pivot axis 108 and results in a force as follows: (spring force×distance 122)/distance 124. The spring force is discussed above. Distance 122 is the distance measured perpendicular to spring axis 116 from spring axis 116 to the center of rotation of pivot axis 108. Distance 124 is the distance measured perpendicular to nip force axis 126 from nip force axis 126 to the center of rotation of pivot axis 108. The nip force can vary due to a number of factors such as as roll manufactured diameter tolerances, roll wear diameter over time, sheet thickness being fed, spring constant tolerances, spring preload tolerance and mounting component tolerances. Roll center distance 128 can vary due to a number of factors including manufactured diameter tolerances, wear diameter over time, sheet thickness being fed, and mounting component tolerances. In the prior art case shown in FIG. 4, as the roll center distance 128 varies, the nip force also varies accordingly. This is due to a spring force increase when the distance 122 increases and a spring force decrease when the distance 122 decreases in the geometry shown. In practice, distance 124 also varies, but in the geometry shown, it is not a predominant factor in determining the change in nip force as a result of roll center distance 128 varying.

Figure 5:
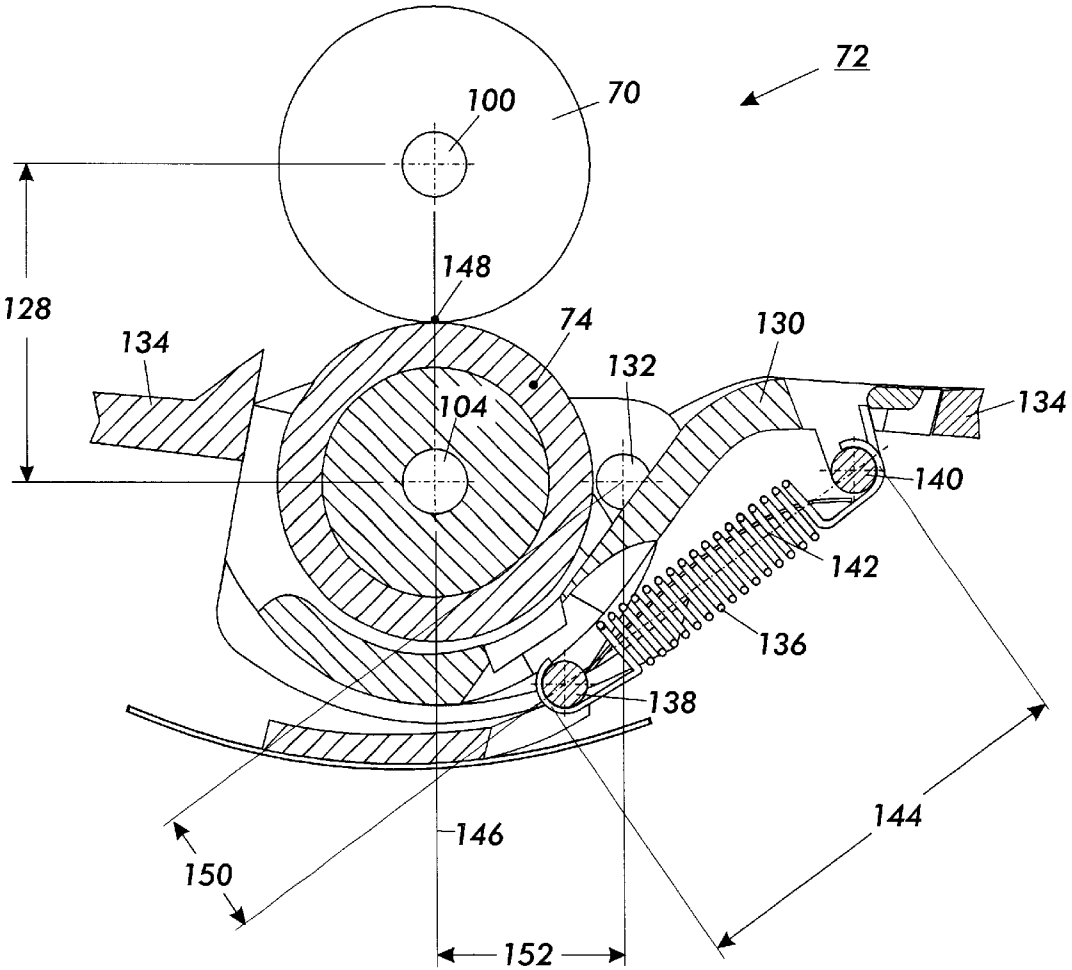
FIG. 5 is a schematic elevation view of a drive according to the present invention.

Referring now to FIG. 5 there is shown is a schematic cross sectional elevation view of an embodiment of the feeder—retard nip 72 according to the present invention of the sheet separator—feeder system 58 shown in FIG. 3. The feeder—retard nip 72 here is defined by an underlying retard (drag) roller 74 engaged by an intermittently driven feed roller 70. Feed roller 70 is rotatable about a feed roll axis 100 which is mounted to frame 134. Retard roller 74 is rotatable about a retard roll axis 104 which is mounted to housing 130. Housing 130 is pivotable about pivot axis 132 which is mounted to frame 134. A spring 136 is connected to frame 134 at frame pin 138 and to housing 130 at housing pin 140. Spring 136 exerts a spring force between frame 134 and housing 130 along a spring axis 142. The magnitude of this spring force is typically equal to (length 144—spring 136's length at rest)×spring 136's spring constant in force per unit length+spring 136's initial preload. For an extension spring as shown, this spring force would increase as length 144 increases and decrease as length 144 decreases. The spring force creates a nip force along a nip force axis 146 at point 148 which is the contact point between roller 74 and roller 70. The nip force is easily computed by summing moments about to the center of rotation of pivot axis 132 and results in a force as follows: (spring force×distance 150)/distance 152. The spring force is discussed above. Distance 150 is the distance measured perpendicular to spring axis 142 from spring axis 142 to the center of rotation of pivot axis 132. Distance 152 is the distance measured perpendicular to nip force axis 146 from nip force axis 146 to the center of rotation of pivot axis 132. The nip force can vary due to a number of factors such as roll manufactured diameter tolerances, roll wear diameter over time, sheet thickness being fed, spring constant tolerances, spring preload tolerance and mounting component tolerances. Roll center distance 128 can vary due to a number of factors including manufactured diameter tolerances, wear diameter over time, sheet thickness being fed, and mounting component tolerances. In order to minimize the change in nip force due to the change in roll center distance 128, the geometry shown compensates such that as the roll center distance 128 varies, the nip force does not varies accordingly as in the prior art shown in FIG. 4. This is due to a spring force increase when the distance 150 decreases and a spring force decrease when the distance 150 increases in the geometry shown. In practice, distance 152 also varies, but in the geometry shown, it is a factor, but not a predominant factor in determining the change in nip force as a result of roll center distance 128 varying. In an alternative geometry that distance 152 varies when roll center distance 128 varies, distance 152 may also be factored in minimizing the change in nip force due to the change in roll center distance 128. In practice, the nip force as a function of center distance 128 can be held substantially constant by a spring set geometry such that spring force increases when (distance 150/distance 152) decreases and such that spring force decreases when (distance 150/distance 152) increases; as a result, the nip force can be held within a desired tighter tolerance than in a geometry such as shown in FIG. 4 when distance 128 varies from a minimum to a maximum due to conditions previously described. An example of holding the tolerance tighter involves comparing results with the geometry in FIG. 4 to results with the geometry of FIG. 5 when using nominally 20 millimeter diameter rollers. With the geometry in FIG. 4, a nip force of 3.5+/−1.9 Newtons was measured with a roll center distance variation of +/−0.7 millimeters. With the geometry in FIG. 5, a nip force of 3.2+/−0.4 Newtons was achieved with a roll center distance variation of +/−2.2 millimeters. With results from the geometry in FIG. 5, the +/−0.4 Newton variation is primarily due to part tolerances as opposed to roll center distance variation. Desired nip force tolerance for a 20 millimeter roll set is +/−0.6 Newtons and the geometry of FIG. 5 achieves this result. Although the feeder—retard nip 72 sheet handling apparatus has been described in detail above, features of the present invention could be used with other types of xerographic processing or printing sections having any suitably blank paper or sheet supply, created document output, image transfer system or paper path.

Figure 6:
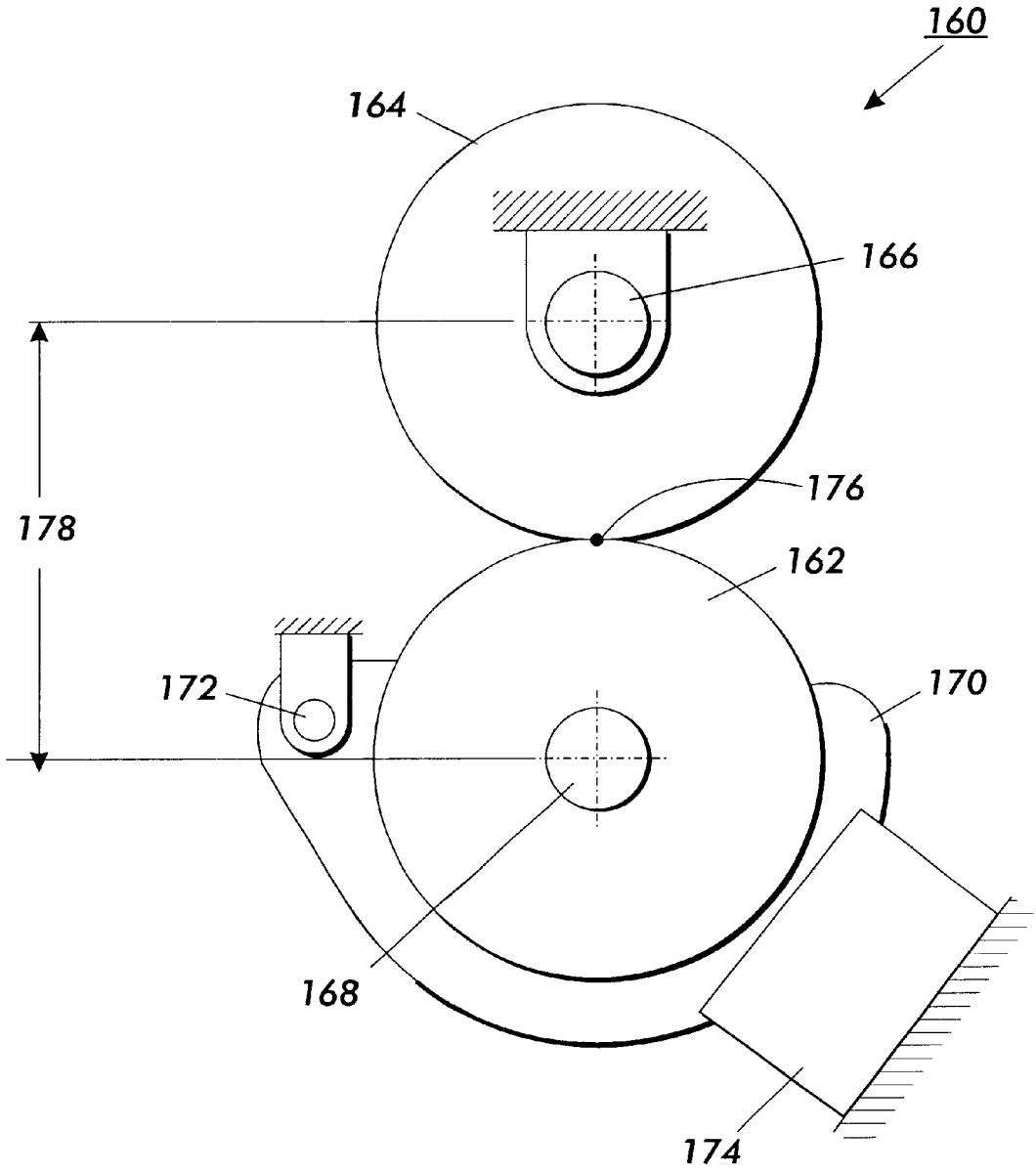
FIG. 6 is a schematic elevation view of a drive according to the present invention.

Referring now to FIG. 6 there is shown is a schematic cross sectional elevation view of an embodiment of the feeder—retard nip 160 according to the present invention. The feeder—retard nip 160 here is defined by an underlying retard (drag) roller 162 engaged by an intermittently driven feed roller 164. Feed roller 164 is rotatable about a feed roll axis 166. Retard roller 162 is rotatable about a retard roll axis 168 which is mounted to housing 170. Housing 170 is pivotable about pivot axis 172. A spring 174 is connected to housing 170. Spring 174 exerts a spring force on housing 170. Spring 174 may be an extension spring compression spring, gas spring, rotary spring or other type of spring or device producing a force on housing 170. The spring force creates a nip force at point 176 which is the contact point between roller 162 and roller 164. The nip force is computed by summing moments about to the center of rotation of pivot axis 172. The nip force can vary due to a number of factors such as roll manufactured diameter tolerances, roll wear diameter over time, sheet thickness being fed, spring constant tolerances, spring preload tolerance and mounting component tolerances. Roll center distance 178 can vary due to a number of factors including manufactured diameter tolerances, wear diameter over time, sheet thickness being fed, and mounting component tolerances. In order to minimize the change in nip force due to the change in roll center distance 178, the geometry is set to compensate such that as the roll center distance 178 varies, the nip force does not varies accordingly as in the prior art shown in FIG. 4. This is due to a spring force increase when the moment arm upon which it acts divided by the moment arm upon which the nip force acts decreases and a spring force decrease when the moment arm upon which it acts divided by the moment arm upon which the nip force acts increases. Although the feeder—retard nip 160 sheet handling apparatus has been described in detail above, features of the present invention could be used with other types of xerographic processing or printing sections having any suitably blank paper or sheet supply, created document output, image transfer system or paper path.

The description above is merely intended to be exemplary. More or less features could also be provided. Although the approach to holding nip force substantially constant has been described with respect to a feeder—retard roll pair, it is equally well suited for any type of feed roll pair such as those shown in FIG. 2 and FIG. 3 for sheet handling, or alternately any roll and belt combination and accordingly the invention is intended to cover all such alternatives. Although the approach to holding nip force substantially constant has been described with respect to an extension spring, it is equally well suited for use with a compression spring, gas spring, rotary spring or other type of spring. Although the approach to holding nip force substantially constant has been applied to a retard roll, it can equally be applied to and suitable for any type of roll including a feed roll, slaved feed roll or free rotating roll.

Figure 7:
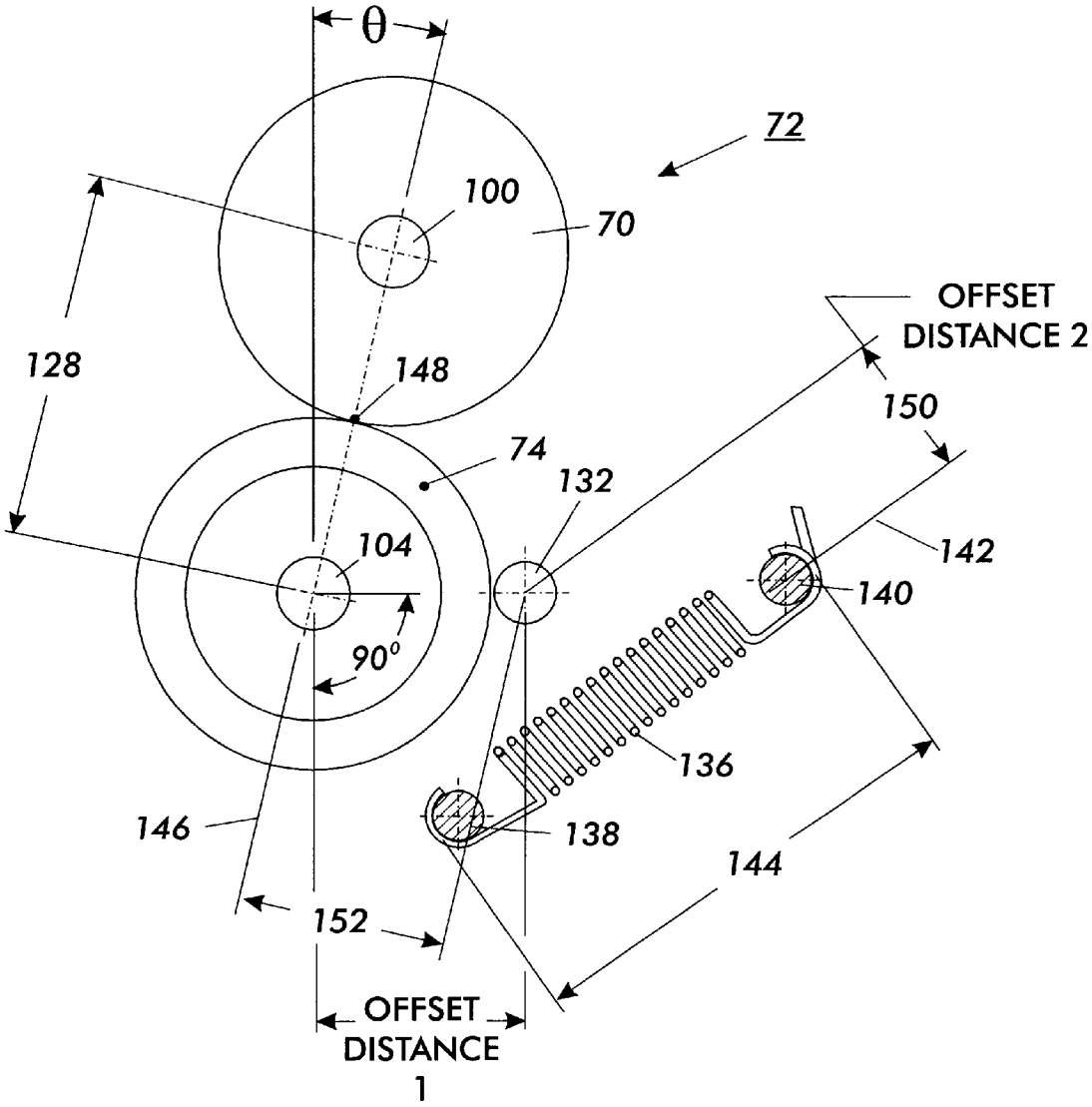
FIG. 7 is a schematic elevation view of a drive according to the present invention.

FIG. 7 clearly illustrates a document creating apparatus as described above (see description of FIG. 5) including overseeing 152 and a first offset offset distance 150, variable distance distance.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A document creating apparatus comprising:

an image transfer system for transferring images onto sheets of material; and a feeder for feeding sheets of material within the image transfer system, the feeder comprising:

a frame;

a housing pivotally connected to the frame on a pivot axis;

a roll rotatably mounted on the housing on a roll axis, the roll axis being offset from the pivot axis, the roll being adapted to contact the sheets of material for individually feeding the sheets of material; and a spring adapted to exert a force along a longitudinal axis thereof between the housing and the frame, the spring being connected to the frame such that said longitudinal axis is offset from said pivot axis to form a moment arm;

wherein, said spring is connected to said housing such that as said housing pivots about said pivot axis, said force and said moment arm vary inversely.

2. The document creating apparatus of claim 1 wherein the roll is a feed roll.

3. The document creating apparatus of claim 2 wherein the feeder further comprises a retard roll adjacent the feed roll, the retard roll connected to the frame and adapted to resist movement of sheets of material.

4. The document creating apparatus of claim 3 further comprising a nudger roll located upstream a paper path of the feed roll, the nudger roll adapted to feed at least one sheet of material from a stack of sheets of material to the feed roll.

5. The document creating apparatus of claim 1 wherein the roll is a retard roll adapted to resist movement of sheets of material.

6. The document creating apparatus of claim 5 the feeder further comprises a feed roll adjacent the retard roll the feed roll connected to the frame.

7. The document creating apparatus of claim 6 further comprising a nudger roll located upstream a paper path of the feed roll, the nudger roll adapted to feed at least one sheet of material from a stack of sheets of material to the feed roll.

8. The document creating apparatus of claim 1, wherein the spring is an extension spring.

9. The document creating apparatus of claim 1 wherein the spring is a compression spring.

10. The document creating apparatus of claim 1 wherein the spring is a torsion spring.

11. The document creating apparatus of claim 1 wherein the feeder further comprises a belt adjacent the roll.

12. A feeder for feeding sheets of material the feeder comprising:

a frame;

a linkage pivotally connected to the frame;

a first roll mounted for rotation on the linkage, the first roll adapted to contact the sheets of material;

a second roll mounted for rotation on the frame, the second roll adjacent the first roll, the second roll adapted to contact the sheets of material;

the first and second roll adapted for individually feeding sheets of material therebetween; and a spring connected between said frame and said linkage causing said linkage to pivot, said pivot action generating a force acting between said first and second rolls, said spring exerting a spring force acting at a moment arm;

wherein, the spring connections to said frame and said linkage are positioned such that, when the distance between the first roll and the second roll is varied, the spring force and said moment arm vary inversely to each other, thereby maintaining the force exerted between the first roll and the second roll is maintained substantially Constant.

13. The feeder of claim 12 wherein the first roll is a feed roll.

14. The feeder of claim 13 wherein the second roll is a retard roll adapted to resist movement of sheets of material.

15. The feeder of claim 14 further comprising a nudger roll located upstream a paper path of the feed roll, the nudger roll adapted to feed at least one sheet of material from a stack of sheets of material to the feed roll.

16. The feeder of claim 12 wherein the first roll is a retard roll adapted to resist movement of sheets of material.

17. The feeder of claim 16 wherein the second roll is a feed roll.

18. The document creating apparatus of claim 17 further comprising a nudger roll located upstream a paper path of the feed roll, the nudger roll adapted to feed at least one sheet of material from a stack of sheets of material to the feed roll.

19. The feeder of claim 12 wherein the spring is an extension spring.

20. The feeder of claim 12 wherein the spring is a Compression spring.

21. The feeder of claim 12 wherein the spring is a torsion spring.

22. The feeder of claim 12 wherein the second roll comprises a belt.

* * * * *